US007096186B2

(12) United States Patent
Funaki

(10) Patent No.: US 7,096,186 B2
(45) Date of Patent: Aug. 22, 2006

(54) DEVICE AND METHOD FOR ANALYZING AND REPRESENTING SOUND SIGNALS IN THE MUSICAL NOTATION

(75) Inventor: Tomoyuki Funaki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/371,760

(22) Filed: Aug. 10, 1999

(65) Prior Publication Data

US 2002/0069050 A1 Jun. 6, 2002

(30) Foreign Application Priority Data

Sep. 1, 1998 (JP) ..... 10-247208

(51) Int. Cl.
*G10I 21/00* (2006.01)

(52) U.S. Cl. ..... 704/278; 704/501; 84/738; 84/726; 84/603; 84/629; 84/627; 381/119; 381/61

(58) Field of Classification Search ..... 704/207, 704/205, 275, 276, 231, 500–504, 278, 201; 84/453, 454, 461, 612, 738, 726, 603, 626, 84/629, 627; 381/119, 61
See application file for complete search history.

(56) References Cited

U.S. PATENT DOCUMENTS 3,894,186 A * 7/1975 Humphrey et al. ..... 704/276
4,024,789 A * 5/1977 Humphrey et al. ..... 84/454
4,688,464 A * 8/1987 Gibson et al. ..... 84/454
4,771,671 A * 9/1988 Hoff, Jr. ..... 84/453
4,777,649 A * 10/1988 Carlson et al. ..... 704/225
4,957,552 A * 9/1990 Iwase ..... 84/622
5,025,703 A * 6/1991 Iba et al.
5,038,658 A * 8/1991 Tsuruta et al. ..... 84/461
5,121,669 A * 6/1992 Iba et al.
5,171,930 A * 12/1992 Teaney ..... 704/207
5,228,098 A * 7/1993 Crinon et al. ..... 382/240
5,231,671 A * 7/1993 Gibson et al. ..... 704/205
5,287,789 A * 2/1994 Zimmerman ..... 84/454
5,446,238 A 8/1995 Koyama et al.

(Continued)

FOREIGN PATENT DOCUMENTS

DE 2351421 A * 5/1974

(Continued)

OTHER PUBLICATIONS

"Notice of Grounds for Rejection" for Japan Patent Application Nr. 11-248087.*

(Continued)

*Primary Examiner*—Vijay Chawan
(74) *Attorney, Agent, or Firm*—Morrison & Foerster LLP

(57) ABSTRACT

Sound signal is received which contains sound characteristics to be represented in musical notation. The characteristics, such as a volume level of the sound signal, are extracted out of the received sound signal, and various parameters for use in subsequent analysis of the sound signal are set in accordance with the extracted characteristics. Also, a desired scale determining condition is set by a user. Pitch of the sound signal is determined using the thus-set parameters. The determined pitch is rounded to any one of scale notes, corresponding to the user-set scale determining condition. Also, a given unit note length is set as a predetermined criterion or reference for determining a note length, and a length of the scale note determined from the received sound signal is determined using the thus-set unit note length as a minimum determination unit, i.e., with an accuracy of the unit note length.

12 Claims, 9 Drawing Sheets

U.S. PATENT DOCUMENTS

| | | | | | |
|---|---|---|---|---|---|
| 5,488,196 | A | * | 1/1996 | Zimmerman et al. | 84/612 |
| 5,524,060 | A | * | 6/1996 | Silfvast et al. | 381/104 |
| 5,536,902 | A | * | 7/1996 | Serra et al. | 84/623 |
| 5,721,390 | A | * | 2/1998 | Adachi et al. | 84/602 |
| 5,936,180 | A | * | 8/1999 | Ando | 84/604 |
| 5,981,860 | A | * | 11/1999 | Isozaki et al. | 84/603 |
| 6,035,009 | A | * | 3/2000 | Shudo | 704/207 |
| 6,140,568 | A | * | 10/2000 | Kohler | 84/654 |
| 6,150,598 | A | * | 11/2000 | Suzuki et al. | 84/603 |
| RE37,041 | E | * | 2/2001 | Koyama et al. | 84/669 |
| 6,898,291 | B1 | * | 5/2005 | Gibson | 381/119 |

FOREIGN PATENT DOCUMENTS

| | | |
|---|---|---|
| JP | 57-000693 | 5/1982 |
| JP | 59-158124 | 9/1984 |
| JP | 63-174096 | 7/1988 |
| JP | 05-181461 | 7/1993 |
| JP | 07-287571 | 10/1995 |
| JP | 09-121146 | 5/1997 |
| JP | 10-149160 | 6/1998 |

OTHER PUBLICATIONS

Iba et al (DERWENT 1991-206971 & 1992-225629).*

* cited by examiner

DEVICE AND METHOD FOR ANALYZING AND REPRESENTING SOUND SIGNALS IN THE MUSICAL NOTATION

BACKGROUND OF THE INVENTION

The present invention relates generally to sound signal analyzing devices and methods for creating a MIDI file or the like on the basis of input sounds from a microphone or the like, and more particularly to an improved sound signal analyzing device and method which can effectively optimize various parameters for use in sound signal analysis.

Examples of the conventional sound signal analyzing devices include one in which detected volume levels and highest and lowest pitch limits, etc. of input vocal sounds have been set as parameters for use in subsequent analysis of sound signals. These parameters are normally set in advance on the basis of vocal sounds produced by ordinary users and can be varied as necessary by the users themselves when the parameters are to be put to actual use.

However, because the input sound levels tend to be influenced considerably by the operating performance of hardware components used and various ambient conditions, such as noise level, during sound input operations, there arises a need to review the level settings from time to time. Further, the upper and lower pitch limits would influence pitch-detecting filter characteristics during the sound signal analysis, and thus it is undesirable to immoderately increase a difference or width between the upper and lower pitch limits. Unduly increasing the width between the upper and lower pitch limits is undesirable in that it would result in a wrong pitch being detected due to harmonics and the like of the input sound. In addition, because the conventional sound signal analyzing devices require very complicated and sophisticated algorithm processing to deal with the pitch detection over a wide pitch range, the processing could not be readily carried out in real time. Moreover, even for some of the parameters appropriately modifiable by the users, it is necessary for the users to have a certain degree of musical knowledge, and therefore it is not desirable for the users to have freedom in changing the parameters. However, because some of the users may produce vocal sounds of a unique pitch range far wider than those produced by ordinary users or of extraordinary high or low pitches, it is very important that the parameters should be capable of being modified as necessary in accordance with the unique tendency and characteristics of the individual users.

SUMMARY OF THE INVENTION

It is therefore an object of the present invention to provide a device and method for analyzing a sound signal for representation in musical notation which can modify various parameters for use in the sound signal analysis in accordance with types of the parameters and characteristics of a user's vocal sound.

In order to accomplish the above-mentioned object, the present invention provides an improved sound signal analyzing device which comprises: an input section that receives a sound signal; a characteristic extraction section that extracts a characteristic of the sound signal received by the input section; and a setting section that sets various parameters for use in analysis of the sound signal, in accordance with the characteristic of the sound signal extracted by the characteristic extraction section. Because of the arrangement that a characteristic of the received or input sound signal is extracted via the extraction section, even when the received sound signal variously differs depending on its sound characteristic (such as a user's singing ability, volume or range), various parameters can be appropriately altered in accordance with the difference in the extracted characteristic of the sound signal, which thereby greatly facilitates setting of the necessary parameters.

For example, the characteristic extraction section may extract a volume level of the received sound signal as the characteristic, and the above-mentioned setting section may set a threshold value for use in the analysis of the sound signal, in accordance with the volume level extracted by the characteristic extraction section. Thus, by setting an appropriate threshold value for use in the sound signal analysis, it is possible to set appropriate timing to detect a start point of effective sounding of the received sound signal, i.e., key-on detection timing, in correspondence to individual users' vocal sound characteristics (sound volume levels specific to the individual users). As a consequence, the sound pitch and generation timing can be analyzed appropriately on the basis of the detection timing.

Alternatively, the characteristic extraction section may extract the upper and lower pitch limits of the sound signal as the characteristic, and the setting section may set a filter characteristic for use in the analysis of the sound signal, in accordance with the upper and lower pitch limits extracted by the characteristic extraction section. By the setting section setting the filter characteristic for the sound signal analysis to within an appropriate range, the characteristic of a band-pass filter or the like intended for sound pitch determination can be set appropriately in accordance with the individual users' vocal sound characteristics (sound pitch characteristics specific to the individual users). In this way, it is possible to effectively avoid the inconvenience that a harmonic pitch is detected erroneously as a fundamental pitch or a pitch to be detected can not be detected at all.

According to another aspect of the present invention, there is provided a sound signal analyzing device which comprises: an input section that receives a sound signal; a pitch extraction section that extracts a pitch of the sound signal received by the input section; a scale designation section that sets a scale determining condition; and a note determination section that, in accordance with the scale determining condition set by the scale designation section, determines a particular one of scale notes which the pitch of the sound signal extracted by the pitch extraction section corresponds to. Because each user is allowed to designate a desired scale determining condition by means of the scale designation section, it is possible to make an appropriate and fine determination of a scale note corresponding to the user-designated scale, without depending only on an absolute frequency of the extracted sound pitch. This arrangement allows each input sound signal to be automatically converted or transcribed into musical notation which has a superior musical quality.

For example, the scale designation section may be arranged to be able to select one of a 12-tone scale and a 7-tone scale as the scale determining condition. Further, when selecting the 7-tone scale, the scale designation section may select one of a normal scale determining condition for only determining diatonic scale notes and an intermediate scale determining condition for determining non-diatonic scale notes as well as the diatonic scale notes. Moreover, the note determination section may set frequency ranges for determining the non-diatonic scale notes to be narrower than frequency ranges for determining the diatonic scale notes.

Thus, the frequency ranges for determining the diatonic scale notes of the designated scale can be set to be narrower than those for determining the non-diatonic scale notes. For the diatonic scale notes, a pitch of a user-input sound, even if it is somewhat deviated from a corresponding right pitch, can be identified as a scale note (one of the diatonic scale notes); on the other hand, for the non-diatonic scale notes, a pitch of a user-input sound can be identified as one of the non-diatonic scale notes (i.e., a note deviated a semitone or one half step from the corresponding diatonic scale note) only when it is considerably close to a corresponding right pitch. With this arrangement, the scale determining performance can be enhanced considerably and any non-diatonic scale note input intentionally by the user can be identified appropriately, which therefore allows each input sound signal to be automatically converted or transcribed into musical notation having a superior musical quality. In addition, the arrangement permits assignment to appropriate scale notes (i.e., scale note determining process) according to the user's singing ability.

Further, the sound signal analyzing device may further comprise: a setting section that sets unit note length as a predetermined criterion for determining a note length; and a note length determination section that determines a length of the scale note, determined by the note determination section, using the unit note length as a minimum determining unit, i.e., with an accuracy of the unit note length. With this arrangement, an appropriate quantization process can be carried out by just variably setting the minimum determining unit, and an appropriate note length determining process corresponding the user's singing ability can be executed as the occasion demands.

The present invention may be implemented not only as a sound signal analyzing device as mentioned above but also as a sound signal analyzing method. The present invention may also be practiced as a computer program and a recording medium storing such a computer program.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Figure 2:
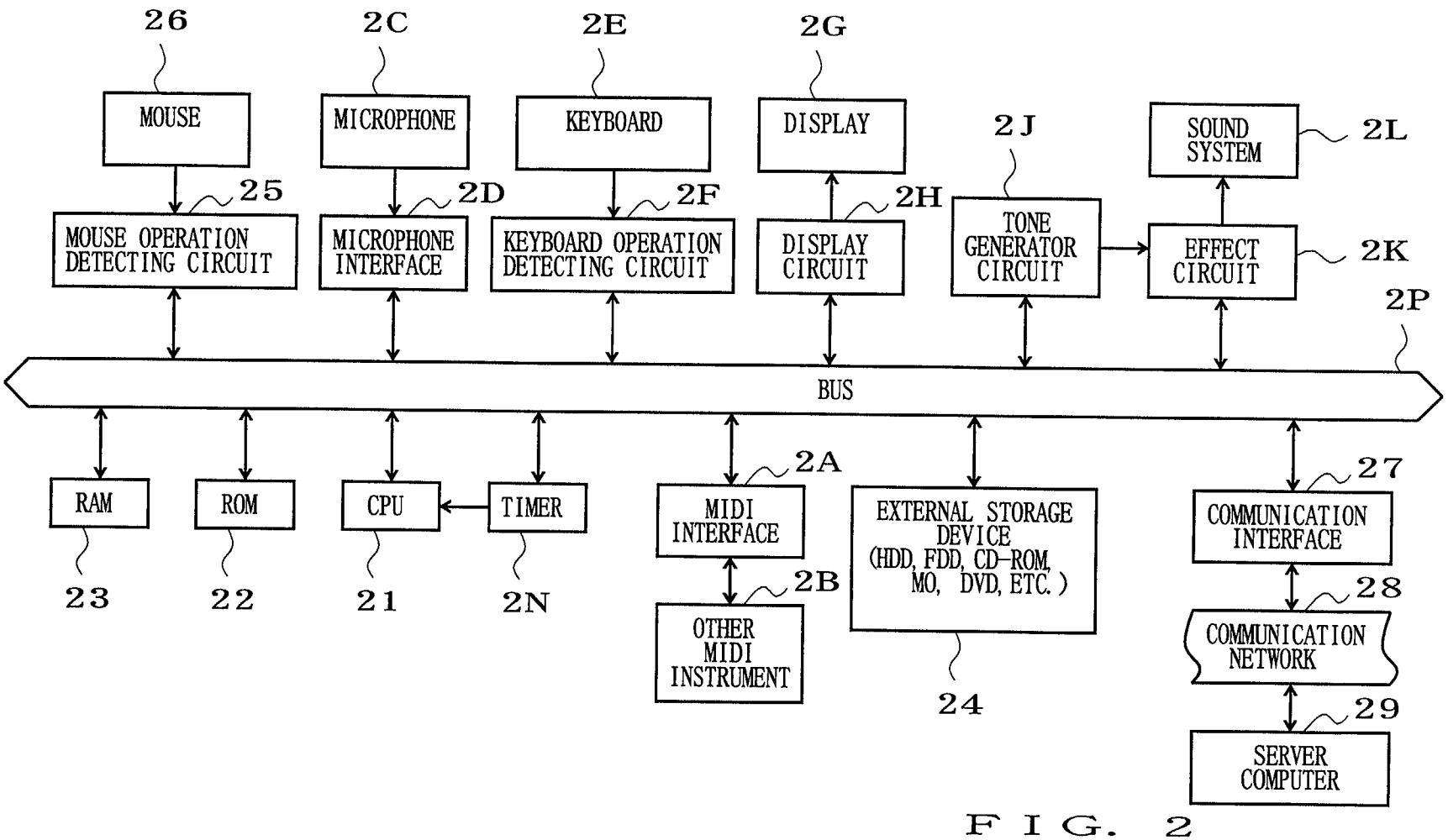
FIG. 2 is a block diagram illustrating a general hardware setup of the personal computer functioning as the sound signal analyzing device.

FIG. 2 is a block diagram illustrating a general hardware setup of a personal computer that functions as a sound signal analyzing device in accordance with an embodiment of the present invention. This personal computer is controlled by a CPU 21, to which are connected, via a data and address bus 2P, various components, such as a program memory (ROM) 22, a working memory 23, an external storage device 24, a mouse operation detecting circuit 25, a communication interface 27, a MIDI interface 2A, a microphone interface 2D, a keyboard (K/B) operation detecting circuit 2F, a display circuit 2H, a tone generator circuit 2J and an effect circuit 2K. While the personal computer may include other hardware components, the personal computer according to this embodiment will be described below as only including these hardware resources essential for implementing various features of the present invention.

The CPU 21 carries out various processes based on various programs and data stored in the program memory 22 and working memory 23 as well as musical composition information received from the external storage device 24. In this embodiment, the external storage device 24 may comprise any of a floppy disk drive, hard disk drive, CD-ROM drive, magneto-optical disk (MO) drive, ZIP drive, PD drive and DVD drive. Composition information and the like may be received from another MIDI instrument 2B or the like external to the personal computer, via the MIDI interface 2A. The CPU 21 supplies the tone generator circuit 2J with the composition information received from the external storage device 24, to audibly reproduce or sound the composition information through an external sound system 2L.

The program memory 22 is a ROM having prestored therein various programs including system-related programs and operating programs as well as various parameters and data. The working memory 23 is provided for temporarily storing data generated as the CPU 21 executes the programs, and it is allocated in predetermined address regions of a random access memory (RAM) and used as registers, flags, buffers, etc. Some or all of the operating programs and various data may be prestored in the external storage device 24 such as the CD-ROM drive rather than in the program memory or ROM 22 and may be transferred into the working memory or RAM 23 or the like for storage therein. This arrangement greatly facilitates installment and version-up of the operating programs etc.

Further, the personal computer of FIG. 2 may be connected via the communication interface 27 to a communication network 28, such as a LAN (Local Area Network), the Internet or telephone line network, to exchange data (e.g., composition information with associated data) with a desired server computer. Thus, in a situation where the operating programs and various data are not contained in the personal computer, these operating programs and data can be downloaded from the server computer to the personal computer. Specifically, in such a case, the personal computer, which is a "client", sends a command to request the server computer 29 to download the operating programs and various data by way of the communication interface 27 and communication network 28. In response to the command, the server computer 29 delivers the requested operating programs and data to the personal computer via the communication network 28. Then, the personal computer receives the operating programs and data via the communication interface 27 and stores them into the RAM 23 or the like. In this way, the necessary downloading of the operating programs and various data is completed.

It will be appreciated that the present invention may be implemented by a commercially-available electronic musical instrument or the like having installed therein the operating programs and various data necessary for practicing the present invention, in which case the operating programs and various data may be stored on a recording medium, such as a CD-ROM or floppy disk, readable by the electronic musical instrument and supplied to users in the thus-stored form.

Mouse 26 functions as a pointing device of the personal computer, and the mouse operation detecting circuit 25 converts each input signal from the mouse 26 into position information and sends the converted position information to the data and address bus 2P. Microphone 2C picks up a human vocal sound or musical instrument tone to convert it into an analog voltage signal and sends the converted voltage signal to the microphone interface 2D. The microphone interface 2D converts the analog voltage signal from the microphone 2C into a digital signal and supplies the converted digital signal to the CPU 21 by way of the data and address bus 2P. Keyboard 2E includes a plurality of keys and function keys for entry of desired information such as characters, as well as key switches corresponding to these keys. The keyboard operation detecting circuit 2F includes key switch circuitry provided in corresponding relation to the individual keys and outputs a key event signal corresponding to a depressed key. In addition to such hardware switches, various software-based button switches may be visually shown on a display 2G so that any of the button switches can be selectively operated by a user or human operator through software processing using the mouse 26. The display circuit 2H controls displayed contents on the display 2G that may include a liquid crystal display (LCD) panel.

The tone generator circuit 2J, which is capable of simultaneously generating tone signals in a plurality of channels, receives composition information (MIDI files) supplied via the data and address bus 2P and MIDI interface 2A and generates tone signals on the basis of the received information. The tone generation channels to simultaneously generate a plurality of tone signals in the tone generator circuit 2J may be implemented by using a single circuit on a time-divisional basis or by providing separate circuits for the individual channels on a one-to-one basis. Further, any tone signal generation method may be used in the tone generator circuit 2J depending on an application intended. Each tone signal generated by the tone generator circuit 2J is audibly reproduced or sounded through the sound system 2L including an amplifier and speaker. The effect circuit 2 is provided, between the tone generator circuit 2J and the sound system 2L, for imparting various effects to the generated tone signals; alternatively, the tone generator circuit 2J may itself contain such an effect circuit. Timer 2N generates tempo clock pulses for counting a designated time interval or setting a desired performance tempo to reproduce recorded composition information, and the frequency of the performance tempo clock pulses is adjustable by a tempo switch (not shown). Each of the performance tempo clock pulses generated by the timer 2N is given to the CPU 21 as an interrupt instruction, in response to which the CPU 21 interruptively carries out various operations during an automatic performance.

Figure 1:
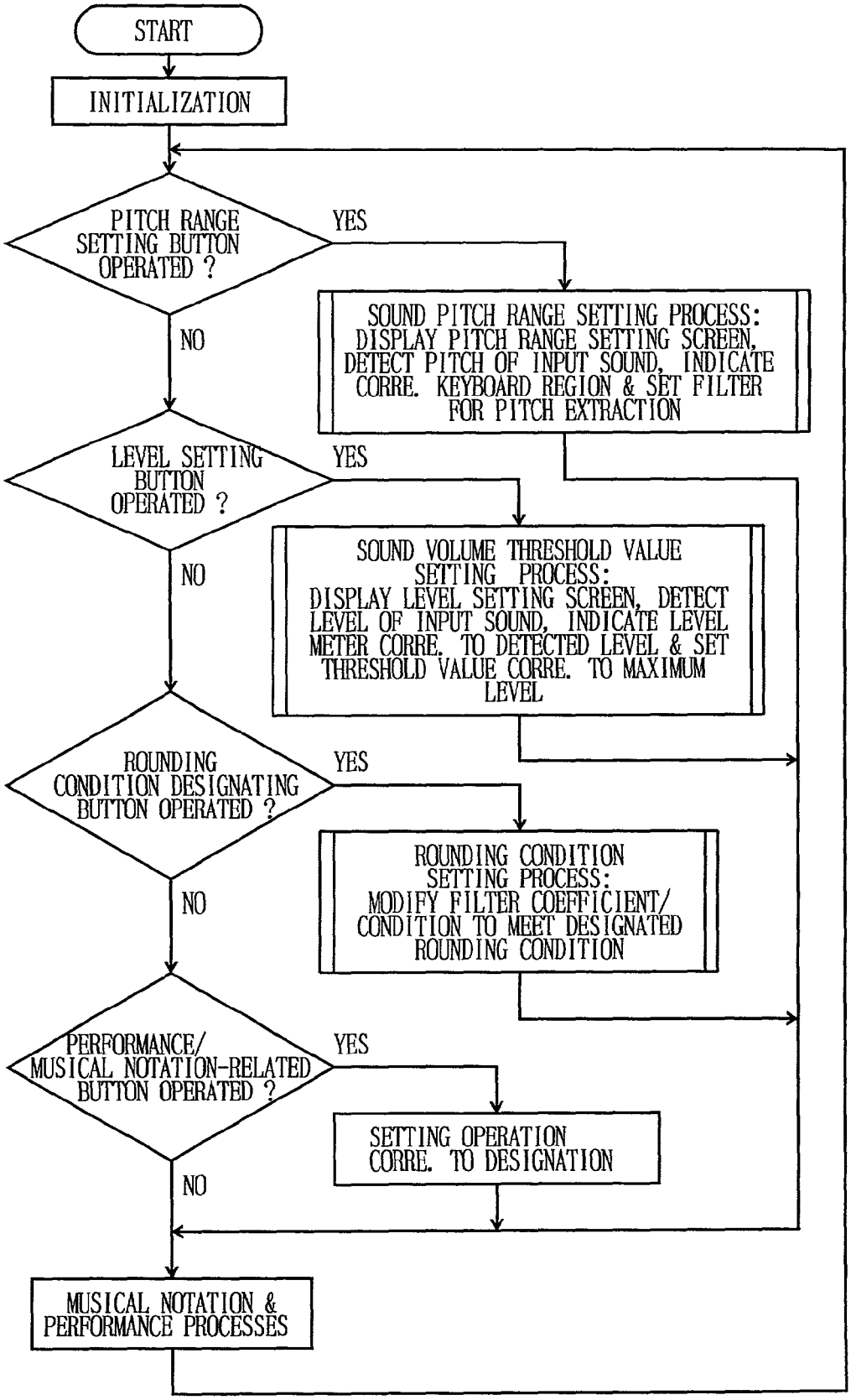
FIG. 1 is a flow chart of a main routine carried out when a personal computer functions as a sound signal analyzing device in accordance with an embodiment of the present invention.

Now, with reference to FIGS. 1 and 3 to 10, a detailed description will be made about the exemplary behavior of the personal computer of FIG. 2 when it functions as the sound signal analyzing device. FIG. 1 is a flow chart of a main routine executed by the CPU 21 of the personal computer functioning as the sound signal analyzing device.

Figure 7:
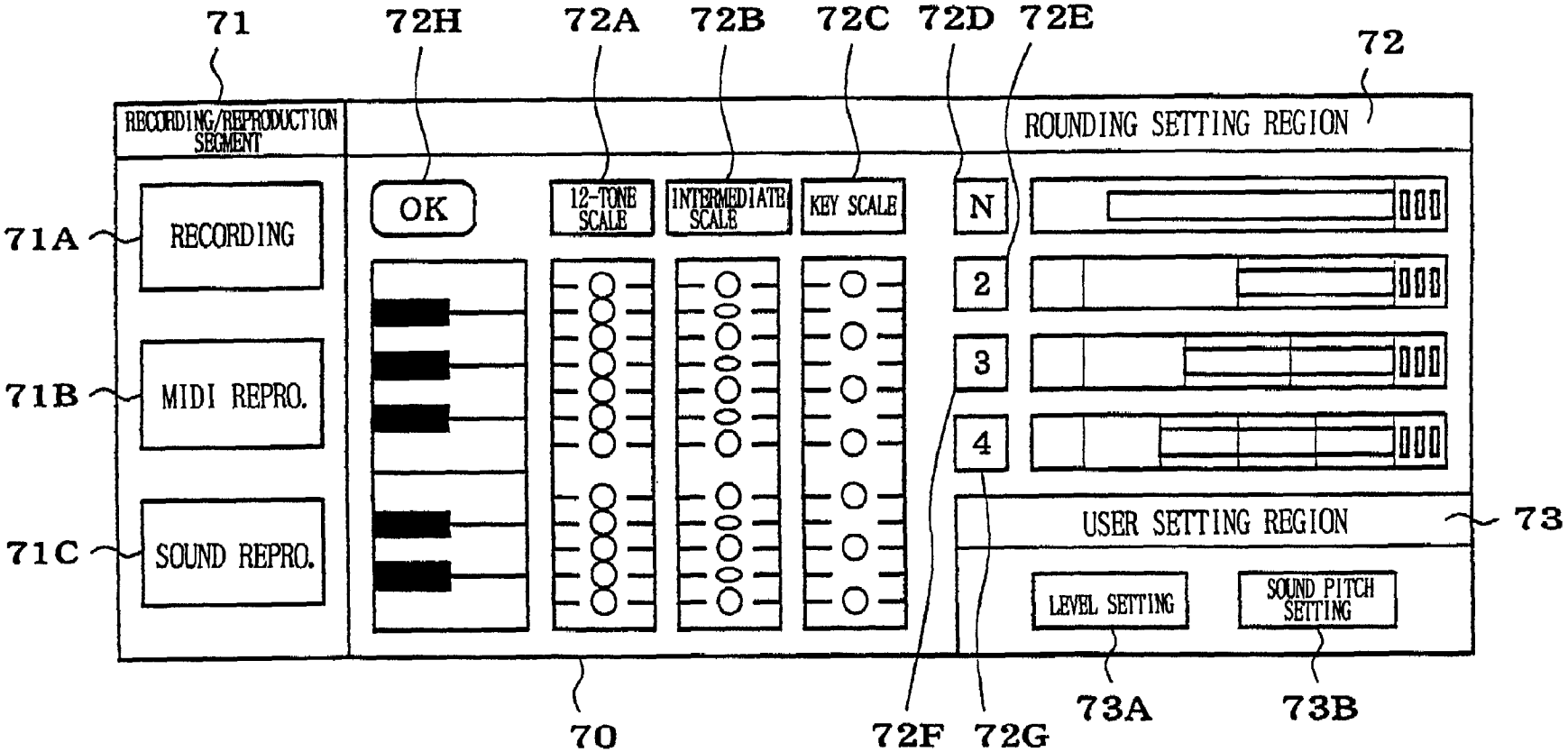
FIG. 7 is a diagram illustrating a parameter setting screen displayed as a result of an initialization process of FIG. 1.

At first step of the main routine, a predetermined initialization process is executed, where predetermined initial values are set in various registers and flags within the working memory 23. As a result of this initialization process, a parameter setting screen 70 is shown on the display 2G as illustrated in FIG. 7. The parameter setting screen 70 includes three principal regions: a recording/reproduction region 71; a rounding setting region 72; and a user setting region 73.

The recording/reproduction region 71 includes a recording button 71A, a MIDI reproduction button 71B and a sound reproduction button 71C. Activating or operating a desired one of the buttons starts a predetermined process corresponding to the operated button. Specifically, once the recording button 71A is operated, user's vocal sounds picked up by the microphone 2C are sequentially recorded into the sound signal analyzing device. Each of the thus-recorded sounds is then analyzed by the sound signal analyzing device to create a MIDI file. Basic behavior of the sound signal analyzing device is described in detail in Japanese Patent Application No. HEI-9-336328 filed earlier by the assignee of the present application, and hence a detailed description of the device behavior is omitted here. Once the MIDI reproduction button 71B is operated, the MIDI file created by the analyzing device is subjected to a reproduction process. It should be obvious that any existing MIDI file received from an external source can also be reproduced here. Further, once the sound reproduction button 71C is operated, a live sound file recorded previously by operation of the recording button 71A is reproduced. Note that any existing sound file received from an external source can of course be reproduced in a similar manner.

The rounding setting region 72 includes a 12-tone scale designating button 72A, an intermediate scale designating button 72B and a key scale designating button 72C, which are operable by the user to designate a desired scale rounding condition. In response to operation of the 12-tone scale designating button 72A by the user, analyzed pitches are allocated, as a scale rounding condition for creating a MIDI file from a recorded sound file, to the notes of the 12-tone scale. In response to operation of the key note scale designating button 72C, pitches of input sounds are allocated, as the rounding condition, to the notes of a 7-tone diatonic scale of a designated musical key. If the designated key scale is C major, the input sound pitches are allocated to the notes corresponding to the white keys. Of course, if the designated key scale is other than C major, the notes corresponding to the black keys can also become the diatonic scale notes. Further, in response to operation of the intermediate scale designating button 72B, a rounding process corresponding to the key scale (i.e., 7-tone scale) is, in principle, carried out, in which, only when the analyzed result shows that the pitch is deviated from the corresponding diatonic scale note approximately by a semitone or one half step, the pitch is judged to be as a non-diatonic scale note. Namely, this rounding process allows the input sound pitch to be allocated to a non-diatonic scale note.

Figure 8A:
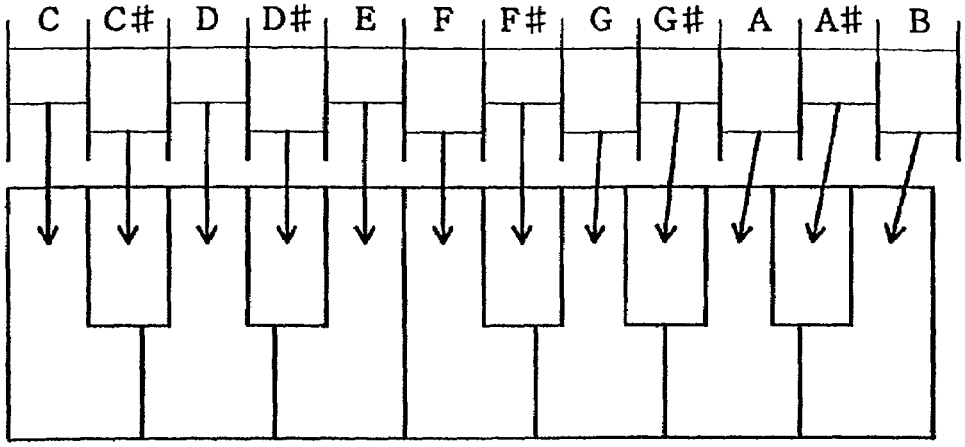
FIGS. 8A, 8B and 8C are diagrams conceptually explanatory of scale rounding conditions corresponding to 12-tone scale designation, intermediate scale designation and key scale designation.
Figure 8B:
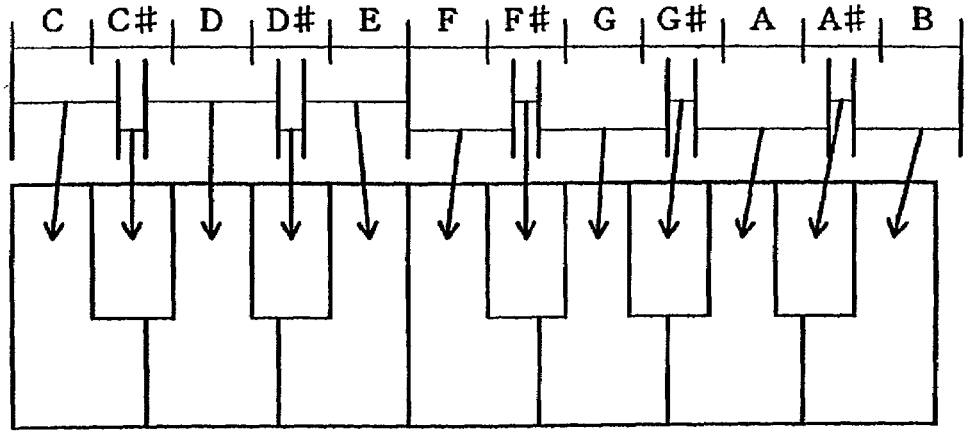
Figure 8C:
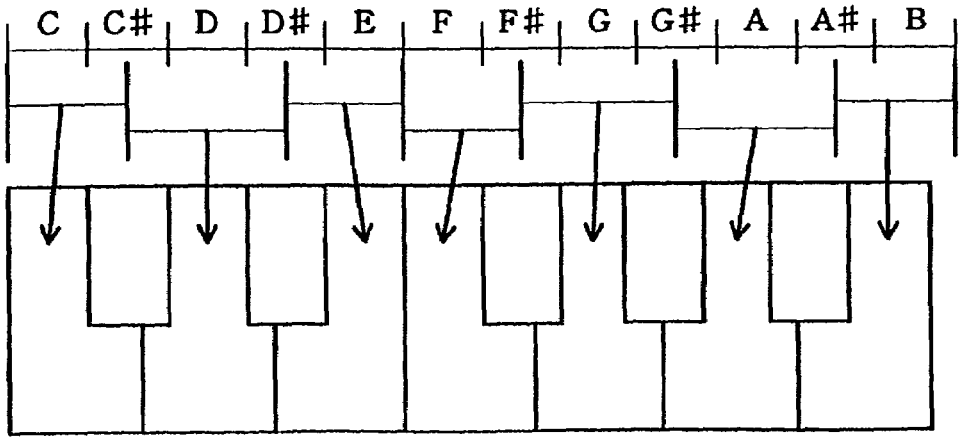

FIGS. 8A to 8C conceptually show different rounding conditions. More specifically, FIGS. 8A, 8B and 8C are diagrams showing concepts of scale rounding conditions corresponding to the 12-tone scale designation, intermediate scale designation and key scale designation. In FIGS. 8A to 8C, the direction in which the keyboard keys are arranged (i.e., the horizontal direction) represents a sound pitch, i.e., sound frequency determined as a result of the sound signal analysis. Thus, for the 12-tone scale designation of FIG. 8A, a boundary is set centrally between pitches of every adjacent scale notes, and the sound frequencies determined as a result of the sound signal analysis are allocated to all of the 12 scale notes. For the key scale designation of FIG. 8C, diatonic scale notes are judged using, as boundaries, the frequencies of the black-key-corresponding notes (C#, D#, F#, G# and A#), i.e., non-diatonic scale notes, and each sound frequency determined as a result of the sound signal analysis is allocated to any one of the diatonic scale notes. For the intermediate scale designation of FIG. 8B, however, the frequency determining ranges allocated to the black-key-corresponding notes (C#, D#, F#, G# and A#), i.e., non-diatonic scale notes, are set to be narrower than those set for the 12-tone scale designation of FIG. 8A, although the frequency allocation is similar, in principle, to that for the 12-tone scale designation of FIG. 8A. More specifically, while an equal frequency determining range is set between the 12 scale notes in the example of FIG. 8A, the frequency determining range between the black-key-corresponding notes, i.e., non-diatonic scale notes, in the example of FIG. 8B is extremely narrower. Note that the frequency determining ranges may be set to any suitable values. The reason why the black-key-corresponding notes (C#, D#, F#, G# and A#), i.e., non-diatonic scale notes, —denoted below the intermediate scale designating button 72B in FIG. 7 for illustration of scale allocation states —are each shown in an oval shape is that they correspond to the narrower frequency determining ranges. Namely, only when the input sound pitch is substantially coincident with or considerably close to the pitch of the non-diatonic scale note, it is judged to be a non-diatonic scale note (i.e., a note deviated from the corresponding diatonic scale note by a semitone).

The rounding setting region 72 also includes a non-quantizing button 72D, a two-part dividing button 72E, a three-part dividing button 72F and a four-part dividing button 72G, which are operable by the user to designate a desired measure-dividing condition for the sound signal analysis. Once any one of these buttons 72D to 72G is operated by the user, the sound file is analyzed depending on a specific number of divided measure segments (i.e., measure divisions) designated via the operated button, to thereby create a MIDI file. To the right of the buttons 72D to 72G of FIG. 7, indicators of measure dividing conditions corresponding thereto are also visually displayed in instantly recognizable form. Namely, the indicator to the right of the non-quantizing button 72D shows that the start point of the sound duration is set optionally in accordance with an analyzed result of the sound file with no quantization. The indicator to the right of the two-part dividing button 72E shows that the start of the sound duration is set at a point corresponding to the length of an eighth note obtained, as a minimum unit note length, by halving one beat (quarter note). Similarly, the indicator to the right of the three-part dividing button 72F shows that the start of the sound duration is set at a point corresponding to the length of a triplet obtained by dividing one beat into three equal parts, and the indicator to the right of the four-part dividing button 72G shows that the start of the sound duration is set at a point corresponding to the length of a 16th note obtained, as a minimum unit note length, by dividing one beat into four equal parts. The number of the measure divisions mentioned above is just illustrative and any number may be selected optionally.

Further, the user setting region 73 of FIG. 7 includes a level setting button 73A and a sound pitch range setting button 73B, activation of which causes a corresponding process to start. Namely, once the level setting button 73A is operated by the user, a level check screen is displayed as exemplarily shown in FIG. 9. This level check screen includes: a level meter area 91 using colored illumination to indicate a current sound volume level on a real-time basis; a level pointer 92 moving vertically or in a direction transverse to the level meter calibrations as the sound volume level rises or falls; a sign 93 indicating that the level pointer 92 corresponds to a level indicating window 94 showing a currently-designated sound volume level in a numerical value; a confirming button ("OK" button) 95 for confirming the designated sound volume level; and a "cancel" button 96 for cancelling a level check process. Any desired numerical value can be entered into the level indicating window 94 directly via the keyboard 2E of FIG. 2. The user's vocal sound is analyzed in accordance with the sound volume level set via the level check screen.

Figure 10:
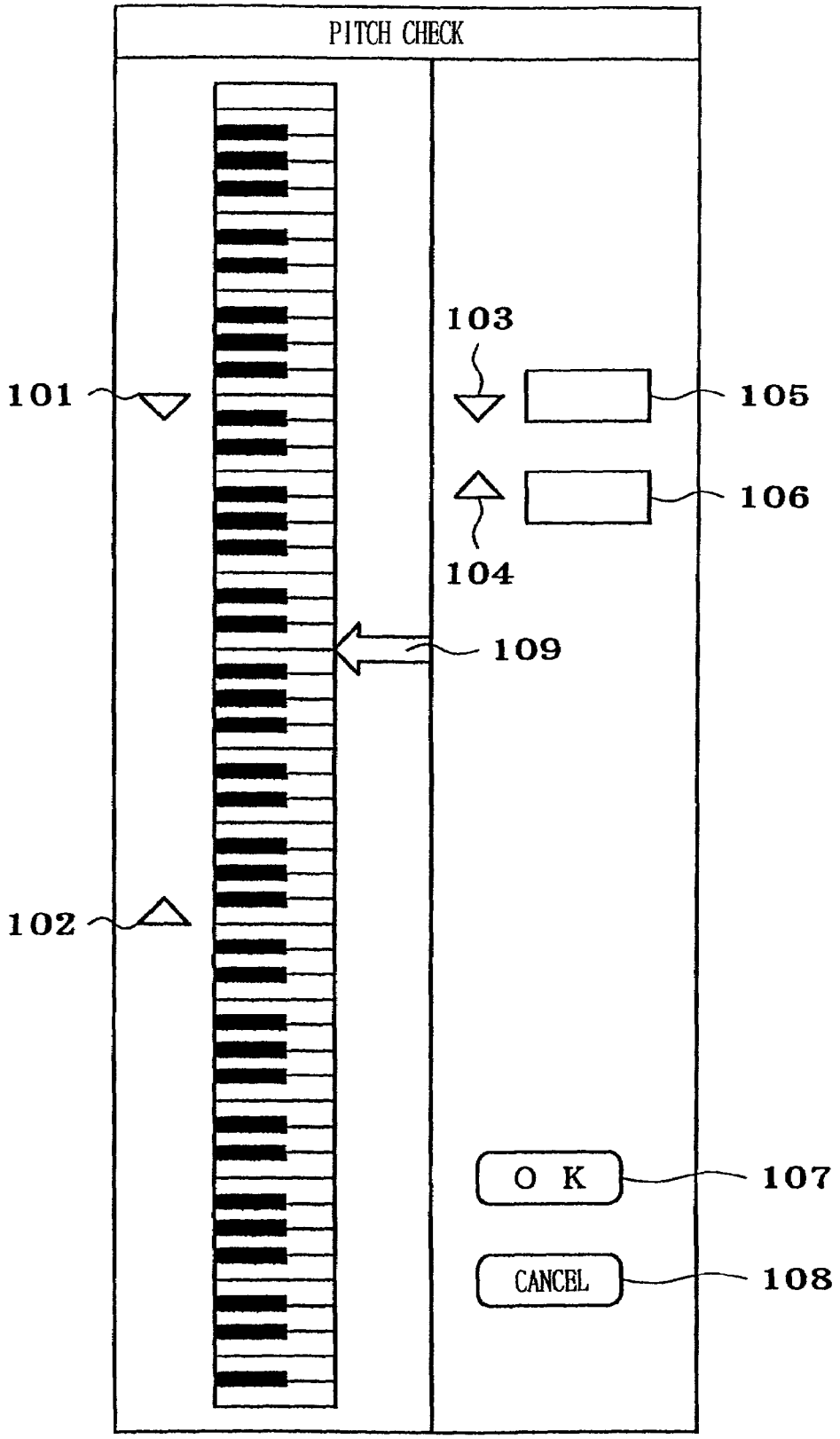
FIG. 10 is a diagram illustrating a dialog screen displayed during the sound pitch range setting process of FIG. 1.

Once the sound pitch range setting button 73B is operated by the user, a pitch check screen is displayed as exemplarily shown in FIG. 10. This pitch check screen includes a first pointer 101 for indicating an upper pitch limit in a currently-set sound pitch range, a second pointer 102 for indicating an lower pitch limit in the currently-set sound pitch range, and a third pointer 109 for indicating a pitch of a vocal sound currently input from the user, which together function to show which region of the keyboard 2E the currently-set sound pitch range corresponds to. The keyboard region in question may be displayed in a particular color different from that of the remaining region of the keyboard, in addition to or in place of using the first and second pointers 101 and 102. The pitch check screen also includes a sign 103 indicating that the first pointer 101 corresponds to a numerical value displayed by an upper pitch limit indicating window 105 located adjacent to the sign 103, and a sign 104 indicating that the second pointer 102 corresponds to a numerical value displayed by a lower pitch limit indicating window 106 located adjacent to the sign 104. Any desired numerical values can be entered into the upper and lower pitch limit indicating windows 105 and 106 directly via the keyboard 2E. The pitch check screen further includes a confirming or "OK" button 107 and a "cancel" button 108 similarly to the above-mentioned level check screen. The user's vocal sound is analyzed in accordance with the sound pitch range set via the pitch check screen.

Figure 3:
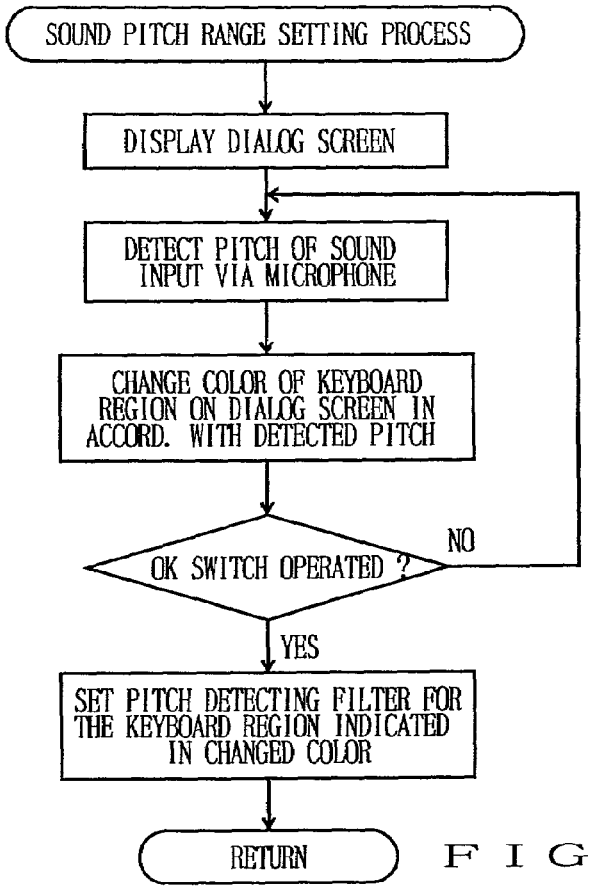
FIG. 3 is a flow chart illustrating details of a sound pitch setting process shown in FIG. 1.

With the parameter setting screen 70 displayed in the above-mentioned manner, the user can set various parameters by manipulating the mouse 2C. The main routine of FIG. 1 executes various determinations corresponding to the user's manipulation of the mouse 2C. Namely, it is first determined whether or not the sound pitch range setting button 73B has been operated by the user, and if an affirmative (YES) determination is made, the routine carries out a sound pitch range setting process as shown in FIG. 3. In this sound pitch range setting process, a predetermined dialog screen is displayed, and detection is made of a pitch of a vocal sound input via the microphone 2C. Then, a user-designated sound pitch range is set as by changing the color of the keyboard region corresponding to the detected sound pitch and also changing the positions of the first and second pointers 101 and 102 on the dialog screen of FIG. 10. Such a series of sound pitch setting operations is repeated until the confirming (OK) button 107 is operated. Then, once the confirming (OK) button 107 is operated, a pitch-extracting band-pass filter coefficient is set in accordance with the keyboard region between the upper and lower pitch limits currently displayed on the dialog screen at the time point when the confirming (OK) button 107 is operated. In this way, the sound pitch range corresponding to the user's vocal sound can be set in the sound signal analyzing device.

Figure 9:
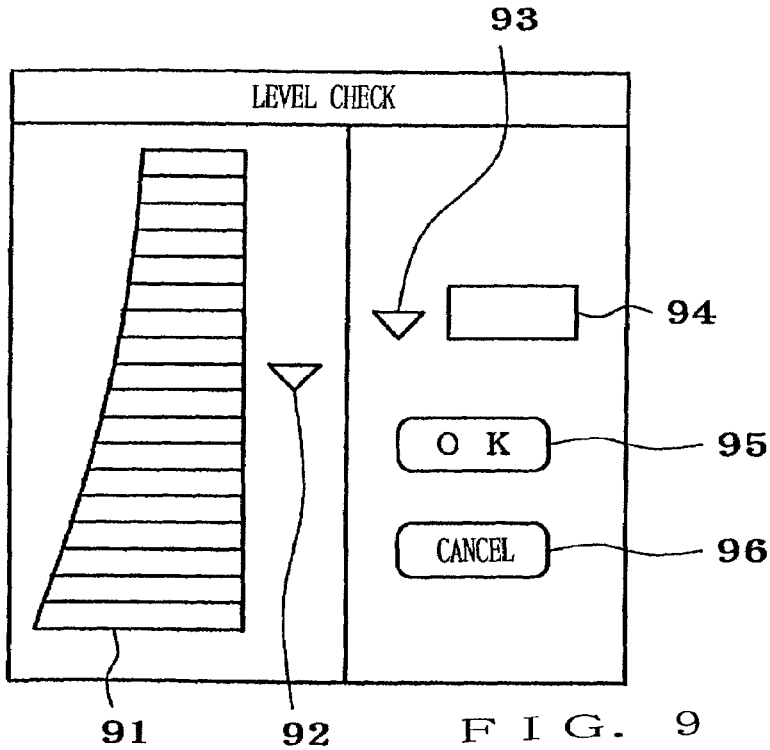
FIG. 9 is a diagram illustrating a dialog screen displayed during the sound-volume threshold value setting process of FIG. 1.
Figure 4:
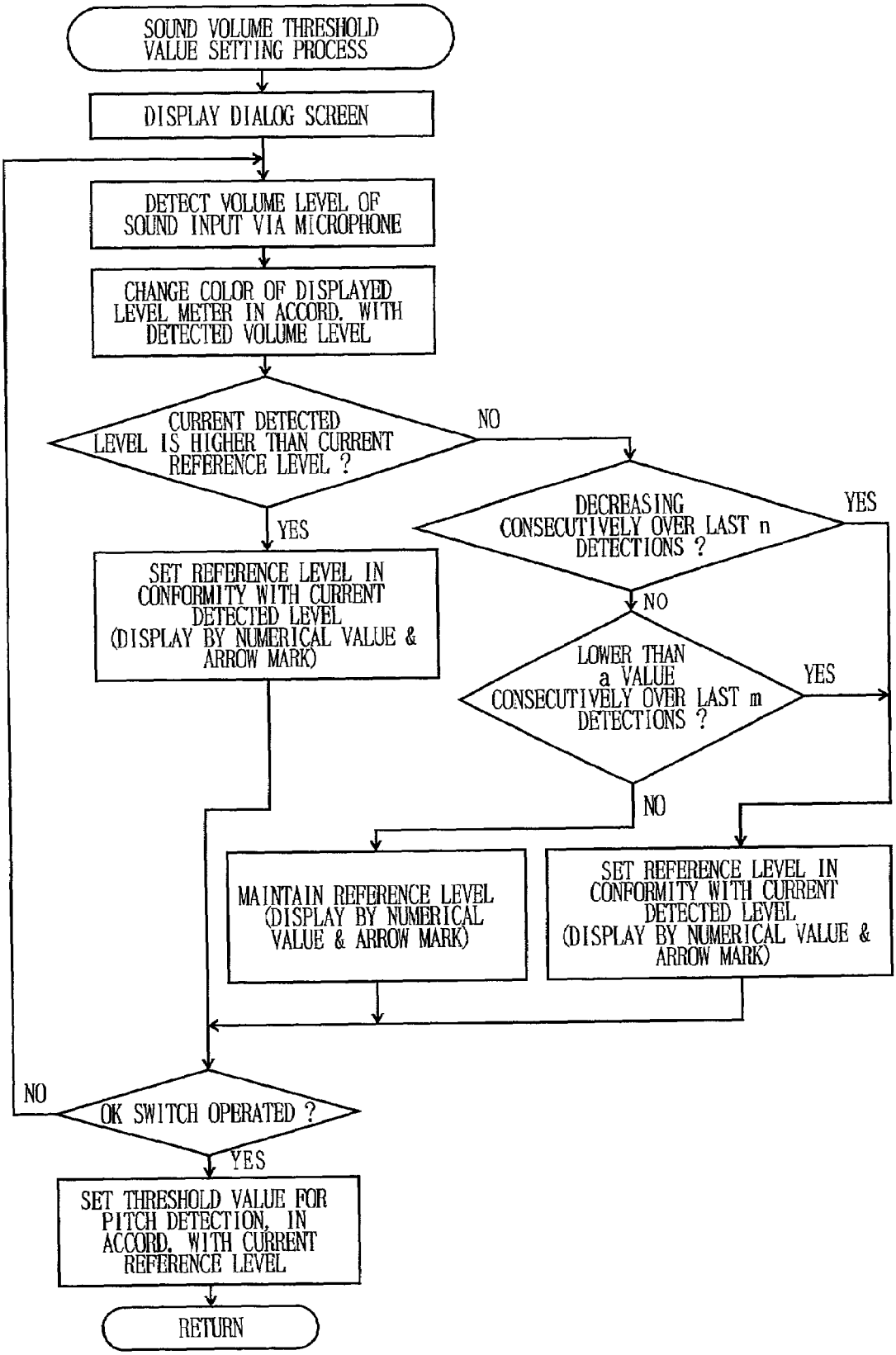
FIG. 4 is a flow chart illustrating details of a sound-volume threshold value setting process shown in FIG. 1.

Next, in the main routine, a determination is made as to whether the level setting button 73A has been operated in the user setting area 73 of the parameter setting screen 70, and with an affirmative (YES) determination, a sound-volume threshold value setting process is carried out as shown in FIG. 4. In this sound-volume threshold value setting process, the dialog screen of FIG. 9 is displayed, and detection is made of a volume level of the vocal sound input via the microphone 2C. Then, the color of the level meter area 91 is varied in real time in accordance with the detected sound volume level. Displayed position of the pointer 92 indicating a maximum sound volume level, i.e., a criterion or reference level, is determined in the following manner. Namely, it is ascertained whether or not the currently-detected sound volume level is higher than the currently-set reference level. If so, the criterion or reference level, i.e., the maximum sound volume level, and the displayed position of the pointer 92 are changed in conformity to the currently detected sound volume level. If, on the other hand, the currently-detected sound volume level is lower than the current reference level, it is further determined whether the sound volume level has been found to be decreasing consecutively over the last n detections; if so (YES), the reference level, i.e., the maximum sound volume level, and the displayed position of the pointer 92 are changed in conformity to the currently detected sound volume level. If the currently-detected sound volume level is lower than the current reference level but the sound volume level has not necessarily been decreasing consecutively over the last n detections, it is further determined whether the sound volume level has been lower than a predetermined "a" value (e.g., 90% of the reference level) consecutively over the last m (m<n) detections; if so (YES), the reference level, i.e., the maximum sound volume level, and the displayed position of the pointer 92 are changed in conformity to the currently-detected sound volume level similarly to the above-mentioned. If, on the other hand, the sound volume level has not been lower than the "a" value consecutively over the last m detections, the current reference level is maintained. Through such a series of operations, the criterion or reference level, i.e., the maximum sound volume level, and the displayed position of the pointer 92 can be varied. The series of operations is repeated until the confirming (OK) button 95 is operated, upon which a sound volume threshold value, for use in pitch detection, key-on event detection or the like, is set in accordance with the maximum sound volume level (reference level) being displayed on the dialog screen of FIG. 9. For instance, a pitch detection process may be performed on sound signals having a volume level greater than the sound volume threshold value, or a process may be performed for detecting, as a key-on event, every detected sound volume level greater than the sound volume threshold value.

Figure 5:
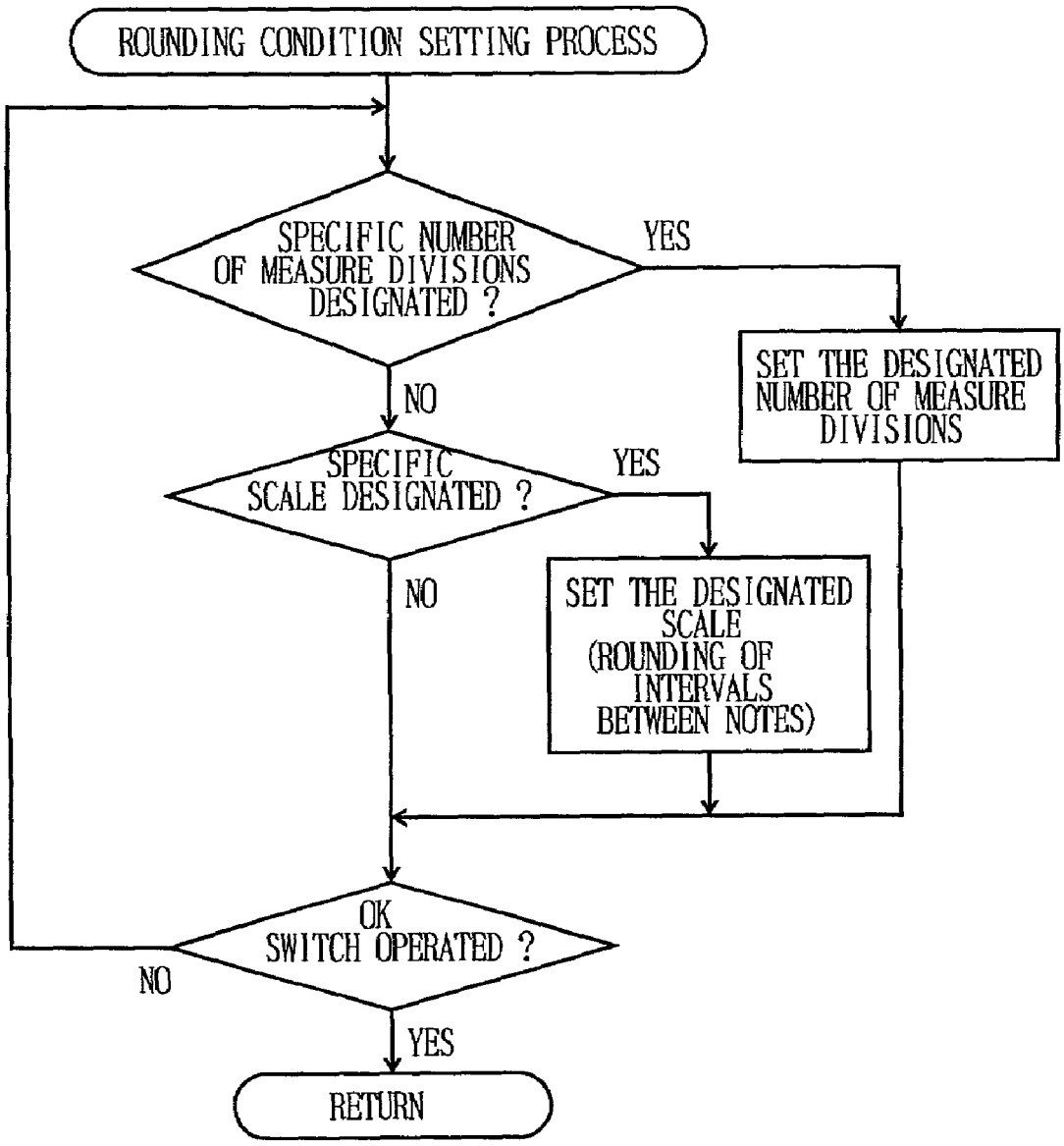
FIG. 5 is a flow chart illustrating details of a process for setting a rounding condition etc. shown in FIG. 1.

Next, in the main routine of FIG. 1, a determination is made as to whether any one of the buttons 72A to 72G has been operated in the rounding setting region 72 of the parameter setting screen 70, and a rounding condition setting process is carried out as exemplarily shown in FIG. 5. In this rounding condition setting process, a different operation is executed depending on the button operated by the user. Namely, if one of the measure dividing buttons 72D to 72G has been operated, it is determined that a specific number of measure divisions has been designated by the user, so that a predetermined operation is executed for setting the designated number of measure divisions. If, on the other hand, one of the rounding condition designating buttons 72A to 72C has been operated, it is determined that a specific scale has been designated, so that a predetermined operation is executed for setting the scale (rounding of intervals or distances between adjacent notes) corresponding to the operated button. Such a series of operations is repeated until the confirming (OK) button 72H is operated.

Finally, in the main routine of FIG. 1, a determination is made as to whether or not any button relating to performance or musical notation (or transcription) (not shown) has been operated by the user, and if so, a predetermined process is carried out which corresponds to the operated button. For example, if a performance start button has been operated by the user, a performance process flag is set up, or if a musical notation (or transcription) process start button has been operated, a musical notation process flag is set up. Upon completion of the above-described operations related to the parameter setting screen 70 of FIG. 7, the musical notation and performance processes are carried out in the instant embodiment. The musical notation process, which is carried out in this embodiment for taking the analyzed sound signal characteristics down on sheet music or score, is generally similar to that described in Japanese Patent Application No. HEI-9-336328 as noted earlier, and therefore its detailed description is omitted here for simplicity. The performance process is carried out on the basis of the conventionally-known automatic performance technique and its detailed description is also omitted here. It should also be appreciated that the musical notation process is performed in accordance with the scale rounding condition selected by the user as stated above.

Figure 6:
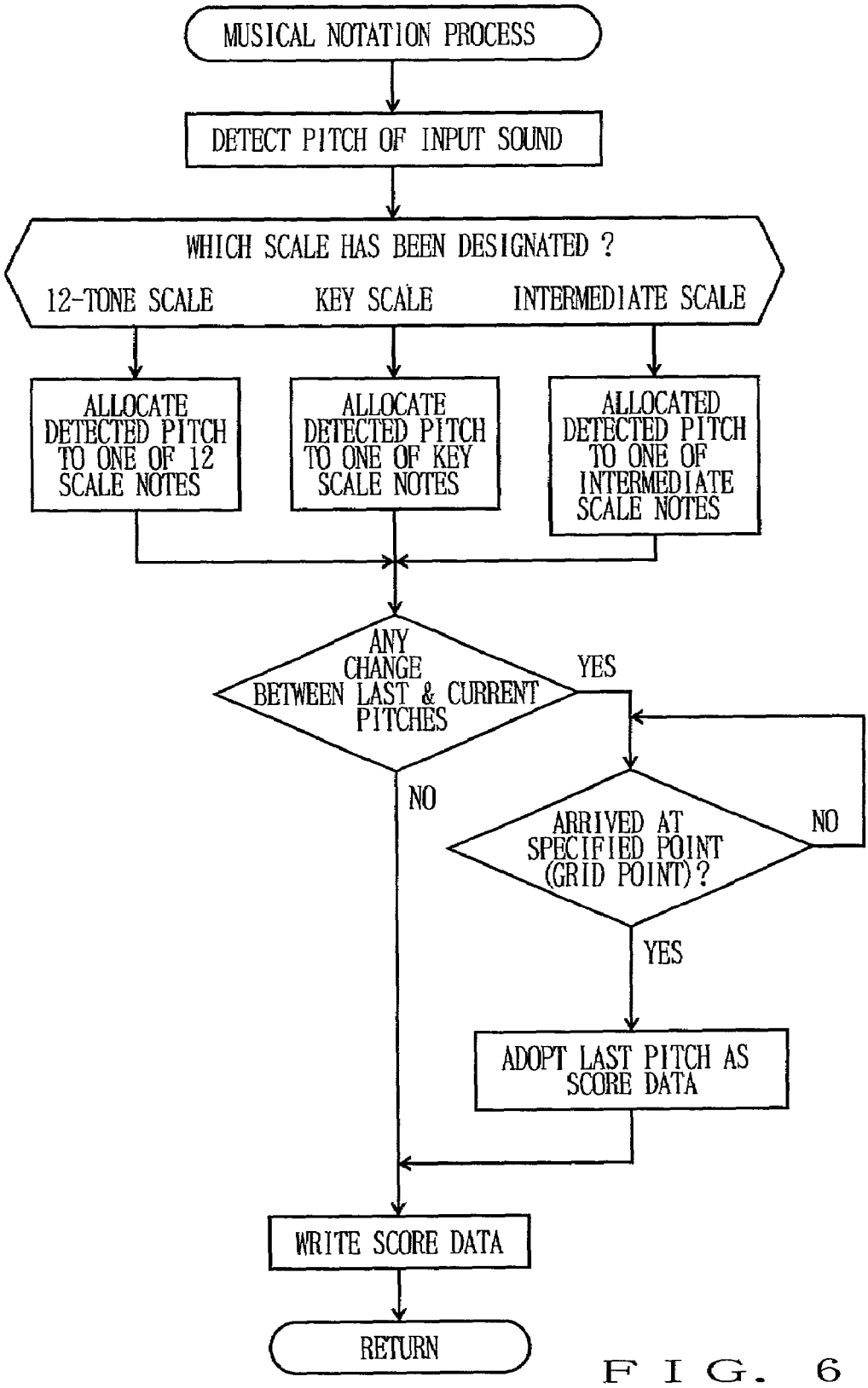
FIG. 6 is a flow chart showing an exemplary operational sequence of a musical notation process of FIG. 1.

FIG. 6 is a flow chart illustrating an exemplary operational sequence of the musical notation process when the process is carried out in real time simultaneously with input of the vocal sound. Namely, while the sound signal analyzing device in the above-mentioned prior Japanese patent application is described as analyzing previously-recorded user's vocal sounds, the analyzing device according to the preferred embodiment of the present invention is designed to execute the musical notation process in real time on the basis of each vocal sound input via the microphone. In this musical notation or transcription process, detection is made of a pitch of each input vocal sound in real time. Note that various conditions to be applied in detecting the sound pitch, etc. have been set previously on the basis of the results of the above-described sound pitch range setting process. The thus-detected pitch is then allocated to a predetermined scale note in accordance with a user-designated scale rounding condition. Then, a determination is made as to whether there is a difference or change between the current allocated pitch and the last allocated pitch. With an affirmative (YES) determination, the same determination is repeated till arrival at a specific area of a measure corresponding to the user-designated measure-dividing condition, i.e., a "grid" point. Upon arrival at such a grid point, the last pitch, i.e., the pitch having lasted up to the grid point, is adopted as score data to be automatically written onto the music score. If there is no such difference or change between the current allocated pitch and the last allocated pitch, i.e., if the same pitch occurs in succession, it is adopted as score data to be written onto the score. By carrying out such a series of musical notation operations (i.e., operations for taking the analyzed signal characteristics down on the score) on the real-time basis, it is possible to create score data from the user's vocal sounds in a very simple manner, although the thus-created data are of rather approximate or rough nature.

In summary, the present invention arranged in the above-mentioned manner affords the superior benefit that various parameters for use in sound signal analysis can be modified or varied appropriately depending on the types of the parameters and characteristics of user's vocal sounds.

What is claimed is:

1. A sound signal analyzing device comprising:

an input section that receives sound signals to be analyzed;

a characteristic extraction section that extracts a volume level of a sound signal as it is received by said input section;

a setting section that sets various parameters for use in subsequent analysis of sound signals received by said input section in accordance with the volume level of the sound signal extracted by said characteristic extraction section, including at least a threshold value; and a display section that visually displays a current value of the volume level and the threshold value determined by an extracted value of the volume level in accordance with a predetermined criterion.

2. A sound signal analyzing device as recited in claim 1 wherein said setting section includes an operator operable by a user, and said setting section, in response to operation of the operator by the user, confirms the volume level of the sound signal displayed by said display section and thereby sets the threshold value.

3. A sound signal analyzing device comprising:

an input section that receives sound signals to be analyzed;

a characteristic extraction section that extracts a pitch of a sound signal as it is received by said input section;

a designating section that, based on the pitch of the sound signal, designates at least one of an upper and lower pitch limit as a pitch limit characteristic;

a setting section that sets various parameters for use in subsequent analysis of sound signals received by said input section in accordance with the pitch limit characteristic, including at least a filter characteristic; and a display section that visually displays the pitch limit characteristic by displaying an image indicative of at least one of the upper and lower pitch limits, wherein a user can vary the pitch limit characteristic by manipulating the image such that the setting section sets the various parameters in accordance with the varied pitch limit characteristic.

4. A sound signal analyzing method comprising the steps of:

receiving sound signals to be analyzed;

extracting a volume level of the sound signal as it is received by said step of receiving;

setting various parameters for use in subsequent analysis of sound signals received by said step of receiving in accordance with the volume level of the sound signal extracted by said step of extracting, including at least a threshold value; and displaying a current value of the volume level and the threshold value determined by an extracted value of the volume level in accordance with a predetermined criterion.

5. A sound signal analyzing method comprising the steps of:

receiving sound signals to be analyzed;

extracting a pitch of a sound signal as it is received by said step of receiving;

designating, based on the pitch of the sound signal, at least one of an upper and lower pitch limit as a pitch limit characteristic;

setting various parameters for use in subsequent analysis of sound signals received by said step of receiving in accordance with the pitch limit characteristic, including at least a filter characteristic; and displaying the pitch limit characteristic by displaying an image indicative of at least one of the upper and lower pitch limits, wherein a user can vary the pitch limit characteristic by manipulating the image to set the various parameters in accordance with the varied pitch limit characteristic.

6. A machine-readable medium containing a group of instructions of a sound signal analyzing program for execution by a computer, said sound signal analyzing program causing the computer to execute the steps of:

receiving sound signals to be analyzed;

extracting a volume level of a sound signal as it is received by said step of receiving;

setting various parameters for use in subsequent analysis of sound signals received by said step of receiving in accordance with the volume level of the sound signal extracted by said step of extracting, including at least a threshold value; and displaying a current value of the volume level and the threshold value determined by an extracted value of the volume level in accordance with a predetermined criterion.

7. A machine-readable medium containing a group of instructions of a sound signal analyzing program for execution by a computer, said sound signal analyzing program causing the computer to execute the steps of:

receiving sound signals to be analyzed;

extracting a pitch of the sound signal as it is received by said step of receiving;

designating, based on the pitch of the sound signal, at least one of an upper and lower pitch limit as a pitch limit characteristic;

setting various parameters for use in subsequent analysis of sound signals received by said step of receiving in accordance with the pitch limit characteristic, including at least a filter characteristic; and displaying the pitch limit characteristic by displaying an image indicative of at least one of the upper and lower pitch limits, wherein a user vary the pitch limit characteristic by manipulating the image to set the various parameters in accordance with the varied pitch limit characteristic.

8. A sound signal analyzing device comprising:

an input section that receives sound signals to be analyzed;

a characteristic extraction section that extracts a characteristic of a sound signal as it is received by said input section;

a setting section that sets at least one parameter for use in subsequent analysis of sound signals received by said input section in accordance with the extracted characteristic of the sound signal;

a detection section for detecting a pitch of a subsequent sound signal in accordance with the at least one parameter;

an allocation section for allocating the detected pitch to a predetermined scale note; and a musical notation section for providing musical notation in accordance with the allocated pitch.

9. The sound signal analyzing device of claim 8 wherein said characteristic is a volume level of the sound signal and wherein said at least one parameter is a threshold value.

10. The sound signal analyzing device of claim 8 wherein said characteristic is at least one of an upper and lower pitch limit of the sound signal and wherein said at least one parameter is a filter characteristic.

11. A sound signal analyzing method comprising:

receiving sound signals to be analyzed;

extracting a characteristic of a sound signal as it is received;

setting at least one parameter for use in subsequent analysis of sound signals received in accordance with the extracted characteristic of the sound signal;

detecting a pitch of a subsequent sound signal in accordance with the at least one parameter;

allocating the detected pitch to a predetermined scale note; and providing musical notation in accordance with the allocated pitch.

12. A machine-readable medium containing a group of instructions of a sound signal analyzing program for execution by a computer, said sound signal analyzing program comprising comprising:

receiving sound signals to be analyzed;

extracting a characteristic of a sound signal as it is received;

setting at least one parameter for use in subsequent analysis of sound signals received in accordance with the extracted characteristic of the sound signal;

detecting a pitch of a subsequent sound signal in accordance with the at least one parameter;

allocating the detected pitch to a predetermined scale note; and providing musical notation in accordance with the allocated pitch.

* * * * *